US008517857B2

(12) United States Patent
Wakabayashi et al.

(10) Patent No.: US 8,517,857 B2
(45) Date of Patent: Aug. 27, 2013

(54) GOLF CLUB SHAFT AND METHOD OF PRODUCING THE SAME

(75) Inventors: Masaki Wakabayashi, Saitama (JP); Yoshihito Kogawa, Saitama (JP); Masaki Nakamura, Minamisouma (JP)

(73) Assignee: Fujikura Rubber Ltd., Tokyo (JP)

( * ) Notice: Subject to any disclaimer, the term of this patent is extended or adjusted under 35 U.S.C. 154(b) by 0 days.

(21) Appl. No.: 13/641,896

(22) PCT Filed: Jan. 14, 2011

(86) PCT No.: PCT/JP2011/050531

§ 371 (c)(1),
(2), (4) Date: Oct. 18, 2012

(87) PCT Pub. No.: WO2012/070253

PCT Pub. Date: May 31, 2012

(65) Prior Publication Data

US 2013/0035177 A1 Feb. 7, 2013

(30) Foreign Application Priority Data

Nov. 24, 2010 (JP) ..... 2010-261707

(51) Int. Cl.
*A63B 53/10* (2006.01)

(52) U.S. Cl.
USPC ..... 473/320

(58) Field of Classification Search
USPC ..... 473/316–323
See application file for complete search history.

(56) References Cited

U.S. PATENT DOCUMENTS

| | | | | | |
|---|---|---|---|---|---|
| 2,809,144 | A | * | 10/1957 | Grimes | 156/192 |
| 3,625,513 | A | * | 12/1971 | Ballmer | 473/310 |
| 5,242,721 | A | * | 9/1993 | Oonuki et al. | 428/34.5 |
| 5,294,119 | A | * | 3/1994 | Vincent et al. | 473/318 |
| 5,297,791 | A | * | 3/1994 | Negishi | 473/321 |
| 5,324,032 | A | * | 6/1994 | Minami | 473/320 |
| 5,632,691 | A | * | 5/1997 | Hannon et al. | 473/292 |
| 5,913,734 | A | * | 6/1999 | Tanaka | 473/320 |

(Continued)

FOREIGN PATENT DOCUMENTS

| | | | |
|---|---|---|---|
| JP | 1-119662 | U | 8/1989 |
| JP | 4-15963 | U | 2/1992 |

(Continued)

OTHER PUBLICATIONS

International search report for PCT/JP2011/050531 dated Apr. 5, 2011.

*Primary Examiner* — Stephen L. Blau
(74) *Attorney, Agent, or Firm* — McCormick, Paulding & Huber LLP

(57) ABSTRACT

An object is to achieve a golf club shaft and a method of producing the same, wherein the weight balance in the shaft longitudinal direction can be reproducibly and easily set and wherein the golf club shaft is produced at a low cost and has high durability. The golf club shaft includes a hollow-cylindrical shaft body made of fiber-reinforced resin and a weight-adding cylinder installed in a cylindrical space of the shaft body. At least a part of an outer diameter side of the weight-adding cylinder is embedded in an cylindrical embedded recess that is formed in an inner wall of the shaft body, wherein a grip-side cylindrical end surface of the weight-adding cylinder and a grip-side cylindrical end surface of the cylindrical embedded recess are in contact with each other.

5 Claims, 9 Drawing Sheets

(56) References Cited

U.S. PATENT DOCUMENTS

| | | | | |
|---|---|---|---|---|
| 6,004,224 | A * | 12/1999 | Tanaka | 473/297 |
| 6,270,426 | B1 * | 8/2001 | Matsumoto | 473/319 |
| 6,935,969 | B2 * | 8/2005 | Kumamoto | 473/319 |
| 6,955,619 | B1 * | 10/2005 | Schutz et al. | 473/560 |
| 7,351,159 | B2 * | 4/2008 | Lai | 473/305 |
| 2003/0224869 | A1 * | 12/2003 | Soong | 473/318 |
| 2006/0046867 | A1 | 3/2006 | Murphy | |
| 2006/0211511 | A1 * | 9/2006 | Cheng | 473/316 |
| 2011/0312435 | A1 * | 12/2011 | DeShiell et al. | 473/289 |

FOREIGN PATENT DOCUMENTS

| | | | |
|---|---|---|---|
| JP | 04038971 | A * | 2/1992 |
| JP | 6-29559 | U | 4/1994 |
| JP | 10151232 | A * | 6/1998 |
| JP | 2001-120696 | A | 5/2001 |
| JP | 2001-346925 | A | 12/2001 |
| JP | 2002248184 | A * | 9/2002 |
| JP | 2003117034 | A * | 4/2003 |
| JP | 4880063 | B1 | 2/2012 |

* cited by examiner

GOLF CLUB SHAFT AND METHOD OF PRODUCING THE SAME

CROSS REFERENCE TO RELATED APPLICATIONS

This application claims the priority of Japanese patent application No. 2010-261707, filed on Nov. 24, 2010 and PCT Application No. PCT/JP2011/050531, filed on Jan. 14, 2011, the disclosures of which are incorporated herein by reference in their entirety.

TECHNICAL FIELD

The present invention relates to a golf club shaft made of carbon (carbon shaft) and a method of producing the same golf club shaft.

BACKGROUND ART

It is known in the art that the position of the center of gravity of a carbon shaft is usually positioned closer to the grip side (butt side) than that of a steel shaft. In recent years, attempts have been made to bring the position of the center of gravity (balance point) of a carbon shaft closer to the tip thereof due to the demand for the carbon shaft to provide the feeling of a steel shaft. To shift the position of the center of gravity of a carbon shaft toward the tip thereof, it is conceivable to increase the weight of the tip of the shaft by increasing the number of layers that are wound around the tip side. However, such a structure increases the rigidity of the tip part of the shaft, which makes the position of the kick point differ largely from those of conventional carbon shafts, thus causing a problem of influencing the ball launch conditions.

To solve such a problem, various ideas for making adjustments to the weight balance of a golf club shaft have been proposed. A golf club shaft made by winding a metal-containing prepreg, which contains metal fibers or metal powder, on an internal layer of the tip of the shaft and thermally curing this metal-containing prepreg is disclosed in, e.g., Japanese unexamined patent publication No. 2001-120696. In addition, a golf club shaft in which a metal core tube is bonded to an internal layer of the tip of the shaft is disclosed in United States Patent Publication 2006/0046867A1.

Technical Problems

However, in the golf club shaft disclosed in Japanese unexamined patent publication No. 2001-120696, the metal-containing prepreg is wound after being positioned at a predetermined position in the shaft longitudinal direction, and accordingly, this position adjustment is difficult to carry out and the reproducibility thereof is poor. Additionally, the metal-containing prepreg is costly, which increases the cost of the entire golf club shaft.

In the golf club shaft disclosed in United States Patent Publication 2006/0046867A1, since a metal core tube is merely bonded to an internal layer of the tip of the shaft, there is a possibility of the metal core tube being delaminated from the internal layer of the tip of the shaft due to an impact which is caused at the time the golf club is swung or the ball is hit, hence, the golf club shaft is low in durability.

The present invention has been devised in view of the above described problems, and an object of the present invention is to achieve a golf club shaft and a method of producing the same, wherein the weight balance (the position of the center of gravity) in the shaft longitudinal direction can be reproducibly and easily set and wherein the golf club shaft is low-cost and has a high durability.

SUMMARY OF THE INVENTION

A golf club shaft according to the present invention is characterized by including a hollow-cylindrical shaft body made of fiber-reinforced resin and a weight-adding cylinder installed in a cylindrical space of the shaft body, wherein at least a part of the outer diameter side of the weight-adding cylinder is embedded in an cylindrical embedded recess formed in an inner wall of the shaft body, while a grip-side cylindrical end surface of the weight-adding cylinder and a grip-side cylindrical end surface of the cylindrical embedded recess are in contact with each other (are made to butt against each other in the shaft longitudinal direction).

According to this structure, for instance, simply by embedding the weight-adding cylinder in the cylindrical embedded recess of the inner wall of the shaft body on the tip side thereof, the golf club shaft that provides a feeling which is closer to that of a steel shaft can be achieved. In addition, a general-purpose member can be used as the weight-adding cylinder, which leads to low cost. Additionally, since the weight-adding cylinder is embedded in the cylindrical embedded recess of the inner wall of the shaft body, and also since the grip-side cylindrical end surface of the weight-adding cylinder and the grip-side cylindrical end surface of the cylindrical embedded recess are in contact with each other (abut against each other in the shaft longitudinal direction), the weight-adding cylinder does not come off the shaft body toward the grip side even if an impact is exerted on the golf club shaft at the time the golf club is swung or the ball is hit, and the durability of the golf club shaft is high.

In the golf club shaft according to an aspect of the present invention, a tip-side cylindrical end surface of the weight-adding cylinder is exposed to a shaft tip end surface of the shaft body. According to this structure, one can confirm that the weight-adding cylinder is embedded in the tip of the shaft body by visually checking the shaft tip end surface of the shaft body. In addition, the weight-adding cylinder can noticeably express a shifting action to shift the center of gravity of the golf club shaft toward the tip of the shaft body.

In the golf club shaft according to another aspect of the present invention, a tip-side cylindrical end surface of the weight-adding cylinder is in contact with a tip-side cylindrical end surface of the cylindrical embedded recess. According to this structure, even if an impact is exerted on the golf club shaft at the time of the golf club is swung or the ball is hit, the weight-adding cylinder not only does not come off the shaft body toward the grip side but also can be securely prevented from coming off the shaft body toward the tip side.

The shaft body can be made of FRP (Fiber Reinforced Plastics) that is formed by winding and thermosetting a plurality of uncured thermosetting resin prepregs.

In this case, it is desirable for the weight-adding cylinder to be covered with a 0-degree prepreg layer which is positioned on the weight-adding cylinder, and a long fiber direction of which is parallel to a shaft longitudinal direction of said golf club shaft. This structure makes the uncured thermosetting resin prepregs easy to wind around the upper layer of the weight-adding cylinder at the time of manufacturing the shaft, thus making it possible to enhance the joint strength between the weight-adding cylinder and a fiber-reinforced resin layer positioned around the weight-adding cylinder when the shaft body is completed.

It is desirable for the contact length in a radial direction between the grip-side cylindrical end surface of the weight-adding cylinder and the grip-side cylindrical end surface of the cylindrical embedded recess to range from 0.05 mm to 0.5 mm. If the contact length in a radial direction is smaller than 0.05 mm, the possibility of the weight-adding cylinder coming off the shaft body toward the grip side upon an impact being exerted on the golf club shaft at the time the golf club is swung or the ball is hit. If this contact length is greater than 0.5 mm, the shaft body becomes excessively thin, which may cause the fiber-reinforced resin layer of the shaft body at this contact portion to collapse, tear or fracture.

It is practical for the weight-adding cylinder to be made of a metallic material.

A method of producing a golf club shaft according to the present invention is characterized by a hollow-cylindrical shaft body made of fiber-reinforced resin and a weight-adding cylinder installed in a cylindrical space of the shaft body, the method including a step of preparing a mandrel having a small diameter portion at a tip of said mandrel with a stepped portion formed between the small diameter portion and the large diameter portion of the mandrel; a step of fitting a weight-adding cylinder on the small diameter portion of the mandrel, the weight-adding cylinder being greater in outer diameter than the large diameter portion; a step of molding the shaft body by winding a plurality of uncured thermosetting resin prepregs around the mandrel on which the weight-adding cylinder is fitted and by thermosetting the plurality of uncured thermosetting resin prepregs; and a step of withdrawing the mandrel to produce the golf club shaft in which at least a part of an outer diameter side of the weight-adding cylinder is embedded in an cylindrical embedded recess that is formed in an inner wall of the shaft body, wherein a grip-side cylindrical end surface of the weight-adding cylinder and a grip-side cylindrical end surface of the cylindrical embedded recess of the shaft body are in contact with each other.

A method of producing a golf club shaft according to another aspect of the present invention is characterized by a hollow-cylindrical shaft body made of fiber-reinforced resin and a weight-adding cylinder installed in a cylindrical space of the shaft body, the method including a step of preparing a mandrel having a small diameter portion at a tip of the mandrel with a stepped portion formed between the small diameter portion and a large diameter portion of the mandrel; a step of winding a 0-degree prepreg around the small diameter portion of the mandrel so as to fill in a radial difference between the small diameter portion and the large diameter portion, a long fiber direction of the 0-degree prepreg being parallel to a shaft longitudinal direction of the golf club shaft; a step of fitting a weight-adding cylinder on the tip side of the 0-degree prepreg-wound cylinder on the small diameter portion of the mandrel, the weight-adding cylinder being substantially the same in outer diameter to the 0-degree prepreg-wound cylinder so as to make a grip-side cylindrical end surface of the weight-adding cylinder and a tip-side cylindrical end surface of the 0-degree prepreg-wound cylinder to abut against each other; a step of molding the shaft body by winding a plurality of uncured thermosetting resin prepregs around the mandrel with the weight-adding cylinder abutting against the 0-degree prepreg-wound cylinder and by thermosetting the plurality of uncured thermosetting resin prepregs; and a step of withdrawing the mandrel to produce the golf club shaft in which at least a part of an outer diameter side of the weight-adding cylinder is embedded in an cylindrical embedded recess formed in an inner wall of the shaft body that includes the 0-degree prepreg-wound cylinder, wherein a grip-side cylindrical end surface of the weight-adding cylinder and a grip-side cylindrical end surface of the cylindrical embedded recess are in contact with each other.

A method of producing a golf club shaft according to yet another aspect of the present invention is characterized by a hollow-cylindrical shaft body made of fiber-reinforced resin and a weight-adding cylinder installed in a cylindrical space of the shaft body, the method including a step of preparing a mandrel having a small diameter portion at a tip of the mandrel with a stepped portion formed between the small diameter portion and a large diameter portion of the mandrel; a step of fitting a weight-adding cylinder on the small diameter portion of the mandrel, the weight-adding cylinder being greater in outer diameter than the large diameter portion and smaller in axial length than the small diameter portion; a step of winding a 0-degree prepreg around a tip-side portion of the small diameter portion of the mandrel on which the weight-adding cylinder is fitted so as to fill in a radial difference between the small diameter portion and a large diameter portion of the weight-adding cylinder, a long fiber direction of the 0-degree prepreg being parallel to a shaft longitudinal direction of the golf club shaft; a step of molding the shaft body by winding a plurality of uncured thermosetting resin prepregs around the mandrel with the 0-degree prepreg-wound cylinder abutting against the weight-adding cylinder and by thermosetting the plurality of uncured thermosetting resin prepregs; and a step of withdrawing the mandrel to produce the golf club shaft in which at least a part of an outer diameter side of the weight-adding cylinder is embedded in an cylindrical embedded recess formed in an inner wall of the shaft body, in which a grip-side cylindrical end surface of the weight-adding cylinder and a grip-side cylindrical end surface of the cylindrical embedded recess are in contact with each other, and in which a tip-side cylindrical end surface of the weight-adding cylinder and a tip-side cylindrical end surface of the cylindrical embedded recess are in contact with each other.

Advantageous Effects of the Invention

According to the present invention, a golf club shaft wherein the weight balance in the shaft longitudinal direction can be reproducibly and easily set, and wherein the golf club shaft is low-cost and has high durability, and a method of producing this golf club shaft, are achieved.

DESCRIPTION OF THE PREFERRED EMBODIMENTS (First Embodiment)

Figure 1:
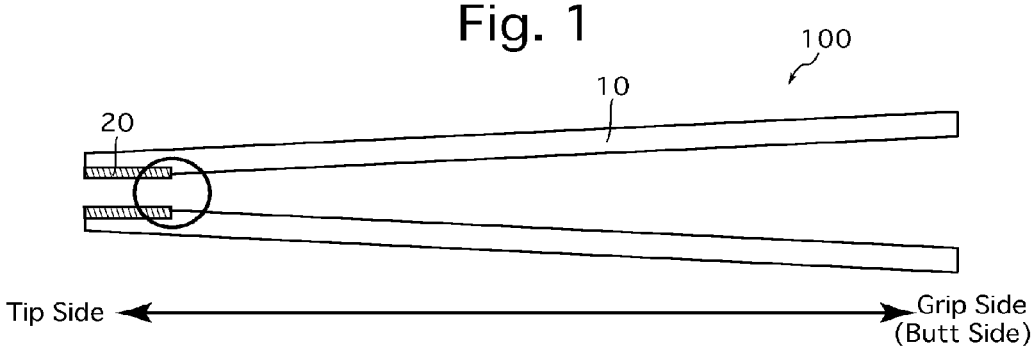
FIG. 1 is a diagram showing the entirety of a golf club shaft as a first embodiment of the present invention.
Figure 2:
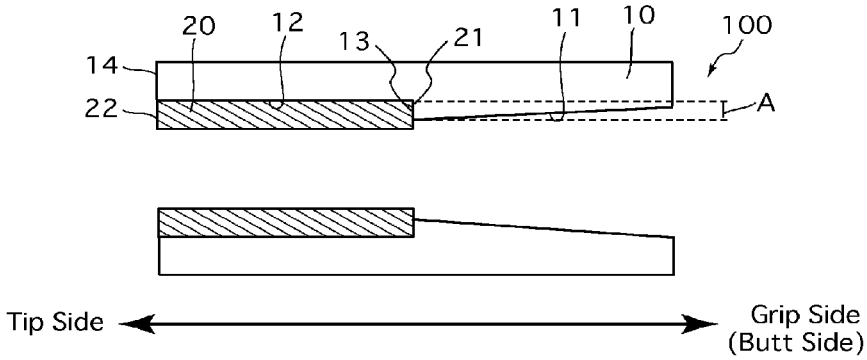
FIG. 2 is an enlarged illustration showing a contact portion of the golf club shaft between a shaft body and a metal cylinder that are shown in FIG. 1.
Figure 3:
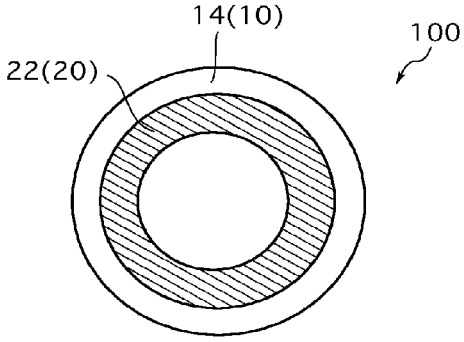
FIG. 3 is a diagram showing the golf club shaft shown in FIG. 1, viewed from the shaft tip.

FIGS. 1 through 3 show a golf club shaft 100 as a first embodiment of the present invention. The golf club shaft 100 is provided with a hollow-cylindrical shaft body 10 made of a fiber-reinforced resin, and a metal cylinder (weight-adding cylinder) 20 installed into the tip end of the shaft body 10. The shaft body 10 is formed into a tapered shape, the outer diameter of which gradually increases toward the grip side (butt side) from the small-diameter tip side (tip side). A club head (not shown) is installed onto the tip end of the shaft body 10, and a grip (not shown) is installed onto the grip-side end of the shaft body 10.

The shaft body 10 is made of an FRP (Fiber Reinforced Plastics) formed by winding and thermosetting a plurality of uncured thermosetting resin prepregs. The material of the metal cylinder 20 is, e.g., iron, aluminum, tungsten, or the like, but can be any material to which a weight can be added, thus not being limited solely to such materials.

The metal cylinder 20, which is installed into the tip end of the shaft body 10, has the effect of shifting the position of the center of gravity (balance point) of the golf club shaft 100 toward the tip thereof. Since the position of the center of gravity of a carbon shaft is usually positioned closer to the grip than that of a steel shaft, the shifting effect that the metal cylinder 20 makes it possible to shift the position of the center of gravity of the golf club shaft 100 toward the tip thereof, thus making it possible to achieve the golf club shaft 100 made of carbon which provides a feeling which is closer to that of a steel shaft.

As shown in FIG. 2, a cylindrical embedded recess 12 is formed in an inner wall 11 of the shaft body 10 at the tip end thereof. The radially outer side of the metal cylinder 20 is partly embedded in the cylindrical embedded recess 12 so that a grip-side cylindrical end surface 21 of the metal cylinder 20 and a grip-side cylindrical end surface 13 of the cylindrical embedded recess 12 are in abut against each other in the shaft longitudinal direction. This structure prevents the metal cylinder 20 from coming off the shaft body 10 toward the grip side even if an impact is exerted on the golf club shaft 100 when the golf club is swung or the ball is hit, thus making it possible to enhance the durability of the golf club shaft 100. Since a club head (not shown) is fixed to the tip end of the shaft body 10, the metal cylinder 20 does not come off the shaft body 10 toward the tip side even if an impact is exerted on the golf club shaft 100 when the golf club is swung or the ball is hit.

It is desirable that a contact length A between the grip-side cylindrical end surface 21 of the metal cylinder 20 and the grip-side cylindrical end surface 13 of the cylindrical embedded recess 12 be determined within the range from 0.05 mm to 0.5 mm. If the contact length A is smaller than 0.05 mm, there is a possibility of the metal cylinder 20 coming off the shaft body 10 toward the grip side upon an impact being exerted on the golf club shaft 100 when the golf club is swung or the ball is hit. If the contact length A is greater than 0.5 mm, the shaft body 10 becomes excessively thin, which may cause the fiber-reinforced resin layer of the shaft body 10 at the contact portion between the grip-side cylindrical end surface 21 of the metal cylinder 20 and the grip-side cylindrical end surface 13 of the cylindrical embedded recess 12 to collapse, tear or fracture.

As shown in FIG. 3, a tip-side cylindrical end surface 22 of the metal cylinder 20 is exposed to a shaft tip end surface 14 of the shaft body 10. This makes it possible for one to confirm that the metal cylinder 20 is embedded in the tip end of the shaft body 10 by visually checking the shaft tip end surface 14 of the shaft body 10. In addition, the metal cylinder 20 can noticeably reveal a shifting action to shift the center of gravity of the golf club shaft 100 toward the tip of the shaft body 100.

Next, a method of producing the golf club shaft 100 that is constructed as described above will be hereinafter discussed with reference to FIGS. 4 through 8.

Figure 4:
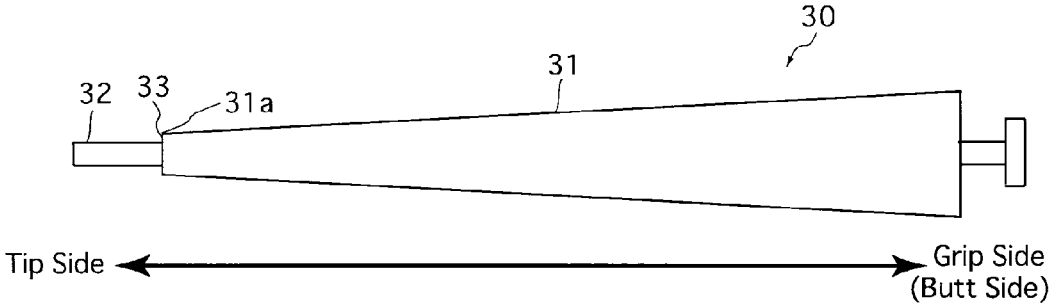
FIG. 4 is a diagram showing the structure of a mandrel used in a method of producing a golf club shaft according to the present invention.

First, as shown in FIG. 4, a mandrel 30 which is provided with a tapered large-diameter portion 31, a columnar (constant-diameter) small-diameter portion 32 and a stepped connecting portion 33 is prepared, wherein the diameter of the large-diameter portion 31 decreases in a direction toward the tip side from the grip side, wherein the small-diameter portion 32 is smaller in diameter than an end 31*a* of the tapered large-diameter portion 31, which is the smallest in diameter in the tapered large-diameter portion 31, and wherein the stepped connecting portion 33 connects the large-diameter portion 31 and the small-diameter portion 32 to each other with a step therebetween. The axial length of the small-diameter portion 32 is substantially identical to that of the metal cylinder 20.

Figure 5:
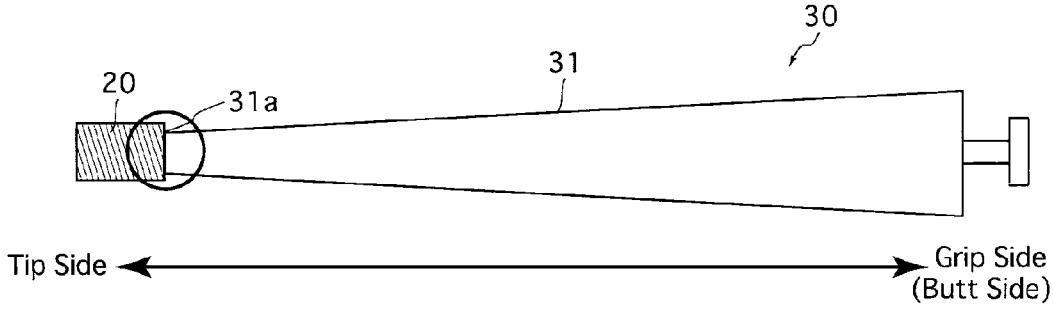
FIG. 5 is a diagram showing a state where the metal cylinder has been fitted on the mandrel shown in FIG. 4.
Figure 6:
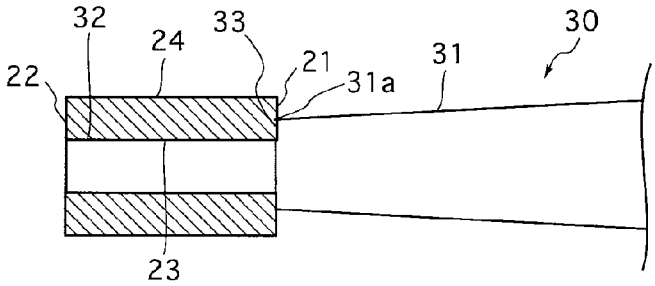
FIG. 6 is an enlarged illustration showing a contact portion between the metal cylinder and the mandrel that are shown in FIG. 5.

Subsequently, as shown in FIG. 5, the metal cylinder 20, which is greater in outer diameter than the end 31*a* of the tapered large-diameter portion 31 closest to the small-diameter portion 32, is fitted on the small-diameter portion 32 of the mandrel 30. In this state, as shown in FIG. 6 as an enlarged view, an inner diameter portion 23 of the metal cylinder 20 is fitted on the small-diameter portion 32 of the mandrel 30 with a minimum clearance, and the grip-side cylindrical end surface 21 of the metal cylinder 20 extends beyond the stepped connecting portion 33 so as to create a radial step between an outer diameter portion 24 of the metal cylinder 20 and the end 31*a* of the tapered large-diameter portion 31.

Figure 7:
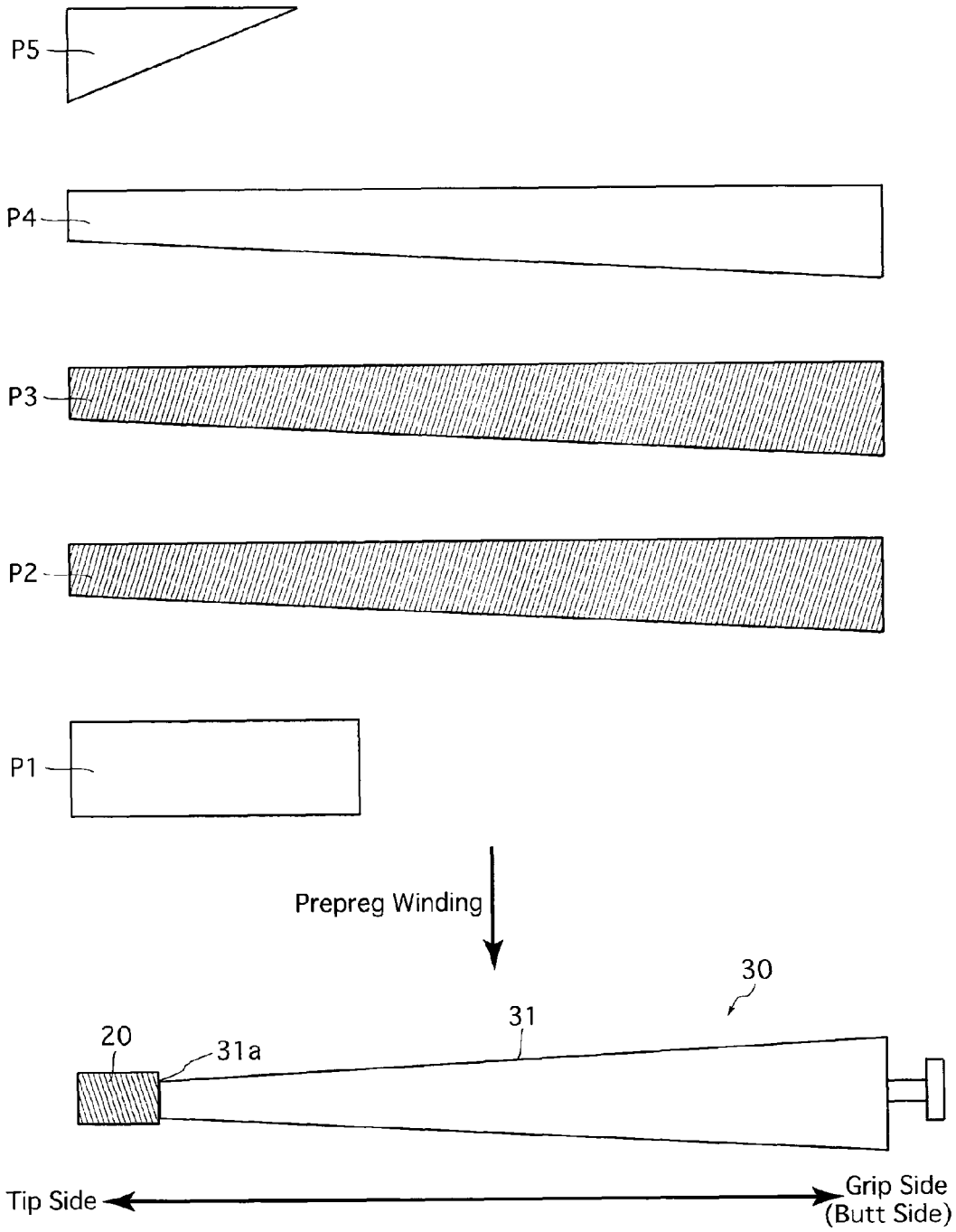
FIG. 7 is a diagram showing the structure of the prepreg constituting the shaft body.

Subsequently, as shown in FIG. 7, the outer peripheral surfaces of the metal cylinder 20 and the large-diameter portion 31 of the mandrel 30 are coated with an adhesive, and a plurality of uncured thermosetting resin prepregs P are wound around the outer peripheral surfaces. More specifically, a metal-cylinder coating prepreg P1, bias prepregs P2 and P3, a straight prepreg P4 and an end-reinforcing prepreg P5 are wound onto the mandrel 30 to which the metal cylinder 20 has been fitted, in that order. The metal-cylinder coating prepreg P1 is a 0-degree prepreg, the long fiber direction of which is parallel to the shaft longitudinal direction and which is wound around the mandrel 30 on the tip side thereof so as to cover the outer diameter portion 24 of the metal cylinder 20. The bias prepregs P2 and P3 are prepregs, the long fiber directions of which are angled at ±45 degrees relative to the shaft longitudinal direction, respectively, and which are wound over the entire length of the mandrel 30. The straight prepreg P4 is a prepreg in which the long fiber direction thereof is parallel to the shaft longitudinal direction and which is wound over the entire length of the mandrel 30. The end-reinforcing prepreg (triangular prepreg) P5 is a prepreg in which the long fiber direction thereof is parallel to the shaft longitudinal direction and which is wound around the tip side of the mandrel 30. The bias prepregs P2 and P3 and the straight prepreg P4, which are wound over the entire length of the mandrel 30, are each formed into a trapezoidal shape which narrows toward the small-diameter tip side from the large-diameter grip side so that the number of turns becomes the same across the full length when wound on the mandrel 30.

Figure 8:
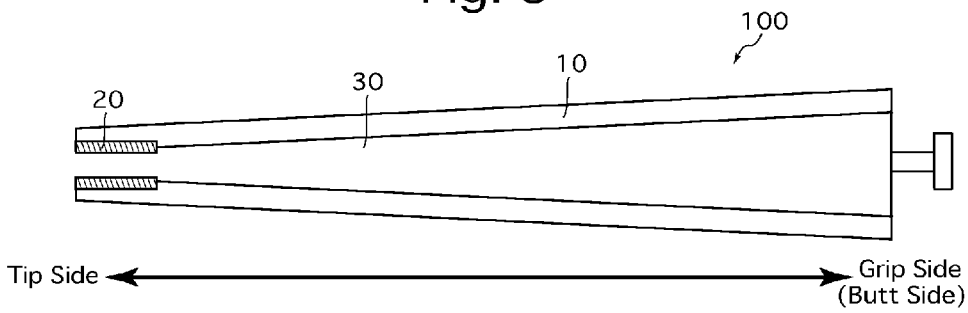
FIG. 8 is a diagram showing a state where the shaft body has been molded by thermally curing uncured thermosetting resin prepregs.

Subsequently, as shown in FIG. 8, the shaft body 10 is formed by thermally curing the uncured thermosetting resin prepregs P wound around the mandrel 30 with the metal cylinder 20 fitted thereon. Thereupon, the prepreg-wound layer that is formed by thermally curing the uncured thermosetting resin prepregs P becomes embedded in the stepped portion between the outer diameter portion 24 of the metal cylinder 20 and the large diameter portion 31 of the mandrel 30 to thereby form the cylindrical embedded recess 12 and the grip-side cylindrical end surface 13.

Lastly, upon the mandrel 30 being withdrawn toward the grip side, the golf shaft club 100, in which the radially outer side of the metal cylinder 20 is partly embedded in the cylindrical embedded recess 12 while the grip-side cylindrical end surface 21 of the metal cylinder 20 and the grip-side cylindrical end surface 13 of the cylindrical embedded recess 12 abut against each other in the shaft longitudinal direction, is completed.

The covering of the outer diameter portion 24 of the metal cylinder 20 with the metal-cylinder coating prepreg P1, which is a 0-degree prepreg in which the long fiber direction thereof is parallel to the shaft longitudinal direction, makes the uncured thermosetting resin prepregs P easy to wind around the upper layer of the metal cylinder 20 at the time of manufacturing the shaft, thus making it possible to enhance the joint strength between the metal cylinder 20 and the shaft body 10, which is positioned around the metal cylinder 20 and made of a fiber-reinforced resin, when the shaft body 10 is completed. The uncured thermosetting resin prepregs P, from which the metal-cylinder coating prepreg P1 is removed, are flexible in structure, so that various modifications can be made to the design of the uncured thermosetting resin prepregs P.

Another method of producing the golf club shaft 100 will be hereinafter discussed with reference to FIGS. 9 through 13.

Figure 9:
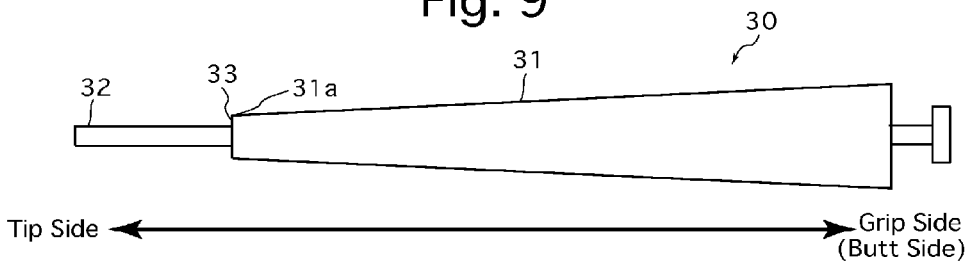
FIG. 9 is a diagram showing the structure of a mandrel used in another method of producing a golf club shaft.

First, as shown in FIG. 9, a mandrel 30, the small diameter portion 32 of which is made to be greater in axial length than the metal cylinder 20 in the structure shown in FIG. 4, is prepared.

Figure 10:
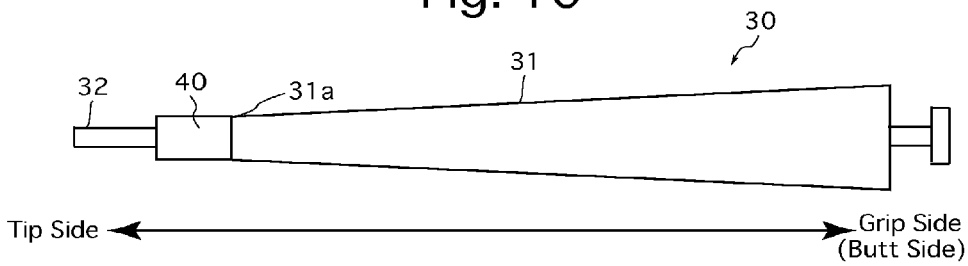
FIG. 10 is a diagram showing a state where a 0-degree prepreg-wound cylinder has been formed on the mandrel shown in FIG. 9.

Subsequently, as shown in FIG. 10, the small diameter portion 32 of the mandrel 30 is coated with an adhesive, and a 0-degree prepreg-wound cylinder 40 is formed by winding a 0-degree prepreg, the long fiber direction of which is parallel to the shaft longitudinal direction, around the small diameter portion 32 so as to fill in the radial difference between the small diameter portion 32 and the large diameter portion 31 (so as to cover the stepped connecting portion 33). The outer diameter of the 0-degree prepreg-wound cylinder 40 is substantially identical to the outer diameter of the metal cylinder 20.

Figure 11:
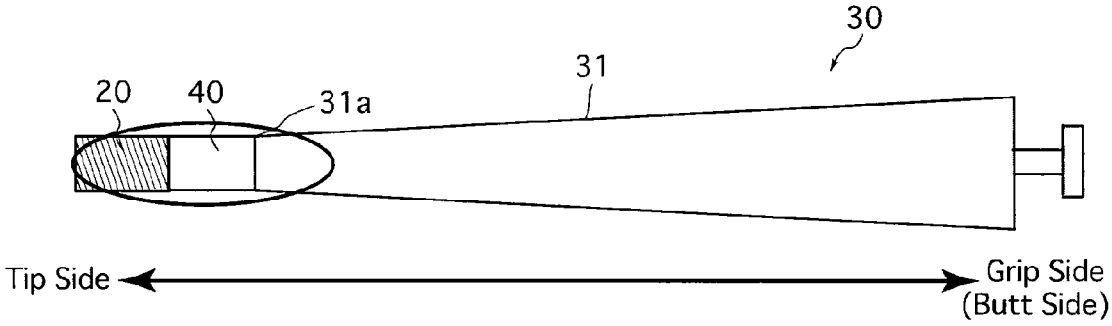
FIG. 11 is a diagram showing a state where a metal cylinder has been fitted on the mandrel shown in FIG. 10.
Figure 12:
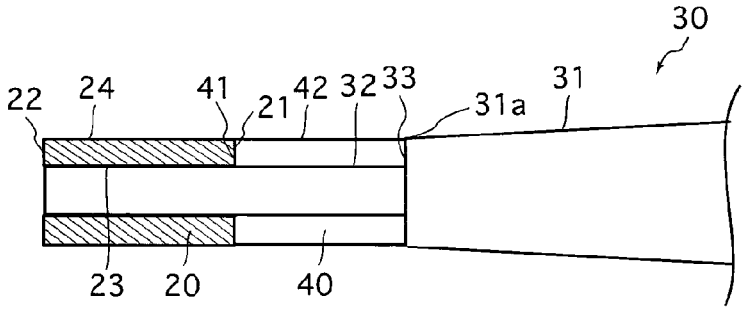
FIG. 12 is an enlarged illustration showing contact portions of the metal cylinder, the 0-degree prepreg-wound cylinder and the mandrel that are shown in FIG. 11.

Subsequently, as shown in FIG. 11, the metal cylinder 20 is fitted on the end of the 0-degree prepreg-wound cylinder 40 on the small diameter portion 32 of the mandrel 30. In this state, as shown in FIG. 12 as an enlarged view, the inner diameter portion 23 of the metal cylinder 20 is fitted on the small-diameter portion 32 of the mandrel 30 with a minimum clearance, and the grip-side cylindrical end surface 21 of the metal cylinder 20 abuts against a tip-side cylindrical end surface 41 of the 0-degree prepreg-wound cylinder 40. No stepped portion is formed between the end 31*a* of the tapered large-diameter portion 31 of the mandrel 30, an outer diameter portion 42 of the 0-degree prepreg-wound cylinder 40, and the outer diameter portion 24 of the metal cylinder 20.

Figure 13:
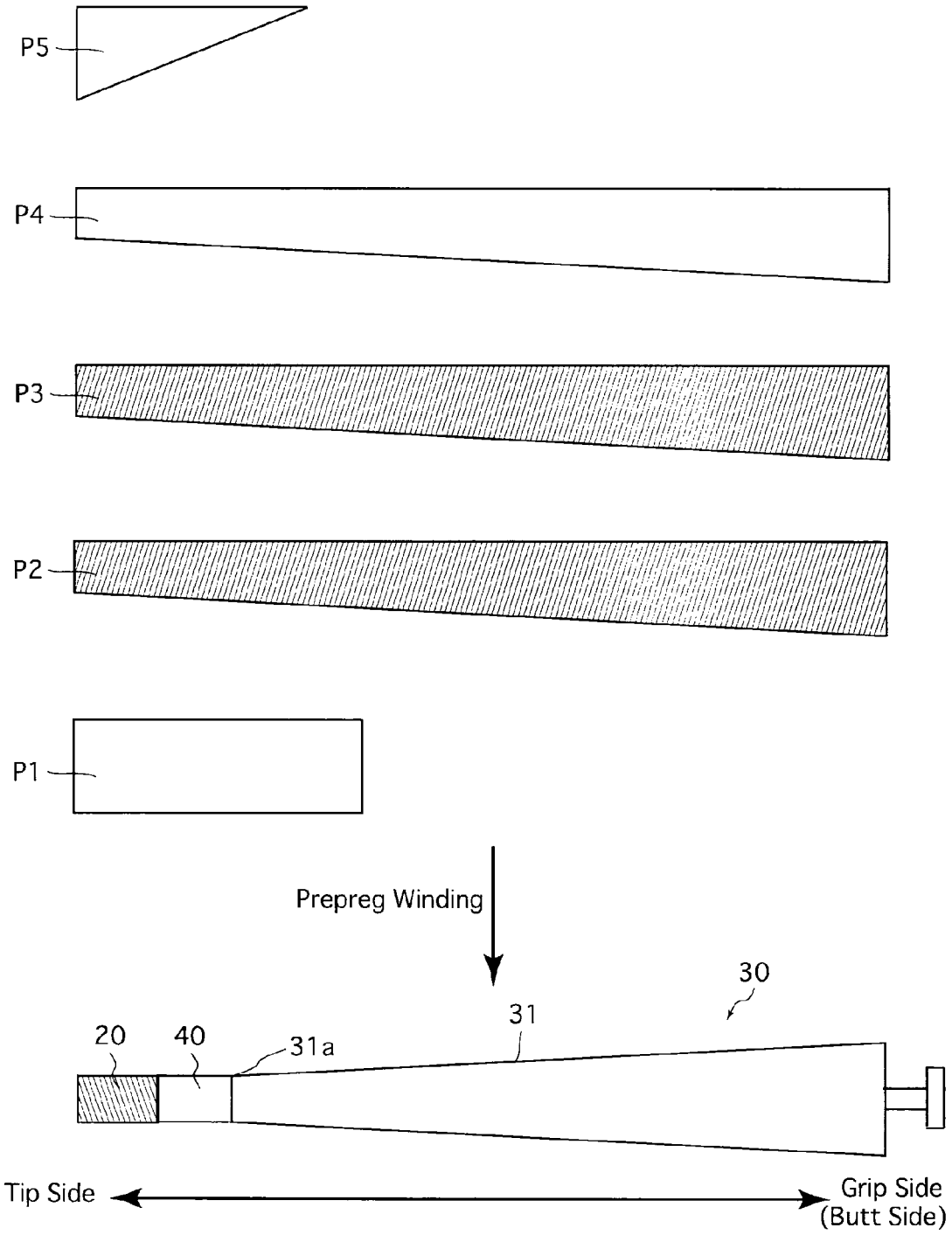
FIG. 13 is a diagram showing the structure of the prepreg constituting the shaft body.

Subsequently, as shown in FIG. 13, the outer peripheral surfaces of the metal cylinder 20 and the large-diameter portion 31 of the mandrel 30 are coated with an adhesive, and a plurality of uncured thermosetting resin prepregs P (the metal-cylinder coating prepreg P1, the bias prepregs P2 and P3, the straight prepreg P4 and the end-reinforcing prepreg P5) identical to those shown in FIG. 7 are wound around the aforementioned outer peripheral surfaces.

Subsequently, the shaft body 10 is formed by thermally curing the uncured thermosetting resin prepregs P that have been wound around the mandrel 30 with the metal cylinder 20 abutting against the 0-degree prepreg-wound cylinder 40. Thereupon, the prepreg-wound layer that is formed by thermally curing the 0-degree prepreg-wound cylinder 40 and the uncured thermosetting resin prepregs P becomes embedded toward the grip side from the grip-side cylindrical end surface 21 of the metal cylinder 20 to thereby form the cylindrical embedded recess 12 and the grip-side cylindrical end surface 13.

Lastly, upon the mandrel 30 being withdrawn toward the grip side, the golf shaft club 100 is completed, in which the radially outer side of the metal cylinder 20 is partly embedded in the cylindrical embedded recess 12 of the shaft body 10 while the grip-side cylindrical end surface 21 of the metal cylinder 20 and the grip-side cylindrical end surface 13 of the cylindrical embedded recess 12 of the shaft body 10 abut each other in the shaft longitudinal direction.

(Second Embodiment)

Figure 14:
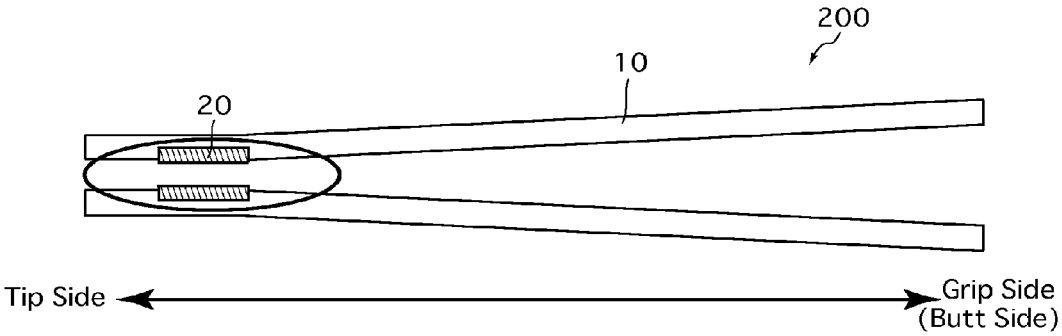
FIG. 14 is a diagram showing the entirety of a golf club shaft as a second embodiment of the present invention.
Figure 15:
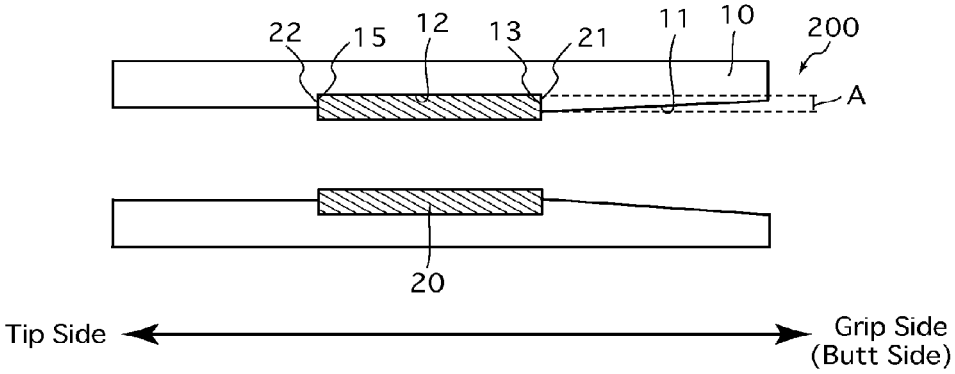
FIG. 15 is an enlarged illustration showing a contact portion of the golf club shaft between a shaft body and a metal cylinder that are shown in FIG. 14.

FIGS. 14 and 15 show a golf club shaft 200 as a second embodiment of the present invention. Portions of the golf club shaft 200 which are identical to those of the first embodiment are designated by the same reference designators and will be omitted from the following description.

As shown in FIG. 14, the golf club shaft 200 is provided with a hollow-cylindrical shaft body 10 made of a fiber-reinforced resin, and a metal cylinder (weight-adding cylinder) 20 installed into the shaft body 10 at a position some distance from the tip end of the shaft body 10 toward the grip side (between the tip end and the grip end). As shown in FIG. 15, a cylindrical embedded recess 12 is formed in an inner wall 11 of the shaft body 10 at a position some distance from the tip end of the shaft body 10 toward the grip side (between the tip end and the grip side end). The radially outer side of the metal cylinder 20 is partly embedded in the cylindrical embedded recess 12 so that a grip-side cylindrical end surface 21 of the metal cylinder 20 and a grip-side cylindrical end surface 13 of the cylindrical embedded recess 12 abut each other in the shaft longitudinal direction and so that a tip-side cylindrical end surface 22 of the metal cylinder 20 and a tip-side cylindrical end surface 15 of the cylindrical embedded recess 12 abut each other in the shaft longitudinal direction.

A method of producing the golf club shaft 200 will be hereinafter discussed with reference to FIGS. 6, 9 and 16 through 18.

First, as shown in FIG. 9, a mandrel 30, the small diameter portion 32 of which is made to be greater in axial length than the metal cylinder 20 in the structure shown in FIG. 4, is prepared.

Figure 16:
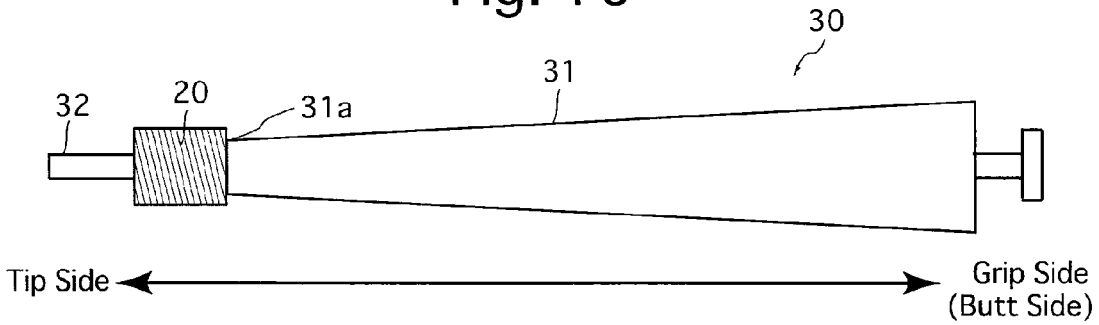
FIG. 16 is a diagram showing a state where the metal cylinder has been fitted on the mandrel shown in FIG. 9.

Subsequently, as shown in FIG. 16, the metal cylinder 20, which is greater in outer diameter than the end 31*a* of the tapered large-diameter portion 31, is fitted on the small-diameter portion 32 of the mandrel 30. In this state, as shown in FIG. 6 as an enlarged view, an inner diameter portion 23 of the metal cylinder 20 is fitted on the small-diameter portion 32 of the mandrel 30 with a minimum clearance, and the grip-side cylindrical end surface 21 of the metal cylinder 20 extends beyond the stepped connecting portion 33 so as to form a radial step between an outer diameter portion 24 of the metal cylinder 20 and the tapered large-diameter portion 31 of the mandrel 30.

Figure 17:
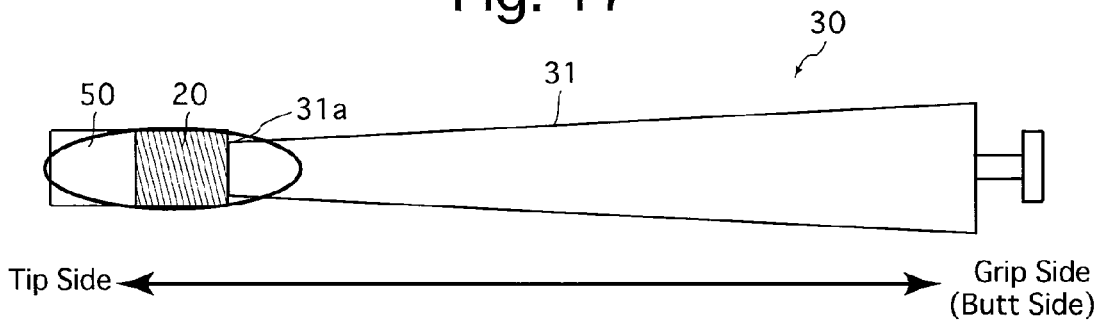
FIG. 17 is a diagram showing a state where a 0-degree prepreg-wound cylinder has been formed on the mandrel shown in FIG. 16.
Figure 18:
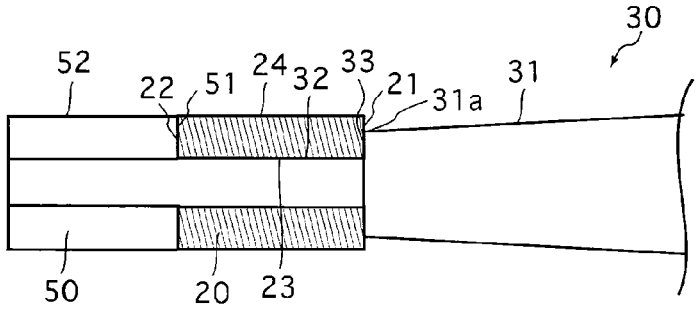
FIG. 18 is an enlarged illustration showing contact portions of the 0-degree prepreg-wound cylinder, the metal cylinder and the mandrel that are shown in FIG. 17.

Subsequently, as shown in FIG. 17, the front end of the metal cylinder 20 at the small diameter portion of the mandrel 30 is coated with an adhesive, and a 0-degree prepreg-wound cylinder 50 is formed by winding a 0-degree prepreg, the long fiber direction of which is parallel to the shaft longitudinal direction, around the small diameter portion 32 so as to fill in the radial difference between the outer diameter portion 24 of the metal cylinder 20 and the small diameter portion 32. In this state, as shown in FIG. 18 as an enlarged view, a grip-side cylindrical end surface 51 of the 0-degree prepreg-wound cylinder 50 abuts against the tip-side cylindrical end surface 22 of the metal cylinder 20. No step is formed between the outer diameter portion 24 of the metal cylinder 20 and an outer diameter portion 52 of the 0-degree prepreg-wound cylinder 50.

Figure 19:
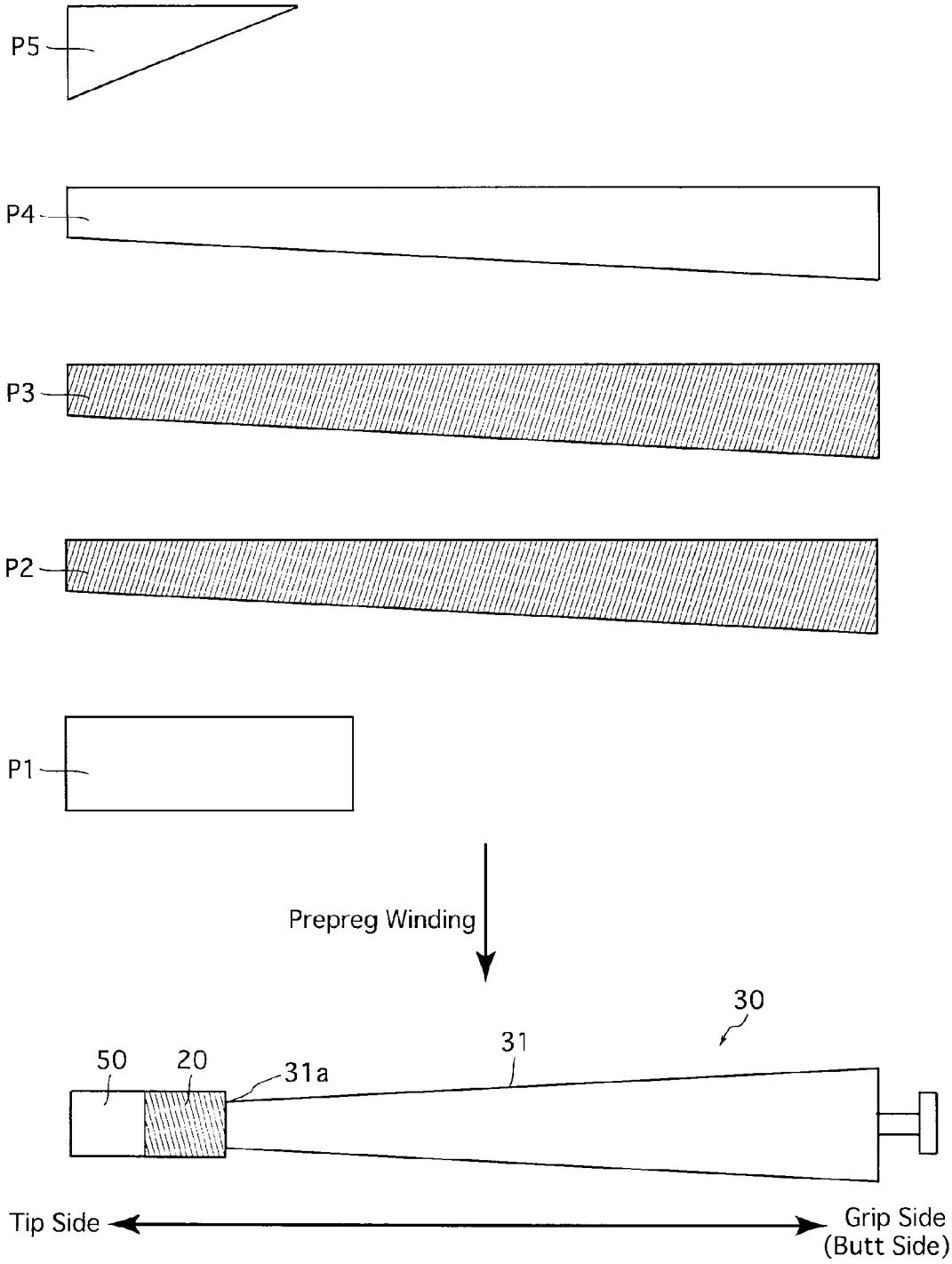
FIG. 19 is a diagram showing the structure of the prepreg constituting the shaft body.

Subsequently, as shown in FIG. 19, the outer peripheral surfaces of the metal cylinder 20 and the large-diameter portion 31 of the mandrel 30 are coated with an adhesive, and a plurality of uncured thermosetting resin prepregs P (the metal-cylinder coating prepreg P1, the bias prepregs P2 and P3, the straight prepreg P4 and the end-reinforcing prepreg P5) that are the same as those shown in FIGS. 7 and 13 are wound around the aforementioned outer peripheral surfaces.

Subsequently, the shaft body 10 is formed by thermally curing the uncured thermosetting resin prepregs P that have been wound around the mandrel 30 with the 0-degree prepreg-wound cylinder 50 abutting against the metal cylinder 20. Thereupon, the prepreg-wound layer that is formed by thermally curing the uncured thermosetting resin prepregs P becomes embedded in the stepped portion between the outer diameter portion 24 of the metal cylinder 20 and the large diameter portion 31 of the mandrel 30 to thereby form the cylindrical embedded recess 12 and the grip-side cylindrical end surface 13. In addition, the prepreg-wound layer that is formed by thermally curing the 0-degree prepreg-wound cylinder 50 and the uncured thermosetting resins prepreg P becomes embedded toward the tip side from the tip-side cylindrical end surface 22 of the metal cylinder 20 to thereby form the cylindrical embedded recess 12 and the tip-side cylindrical end surface 15.

Lastly, upon the mandrel 30 being withdrawn toward the grip side, the golf shaft club 200 like that described with reference to FIGS. 14 and 15, in which the radially outer side of the metal cylinder 20 is partly embedded in the cylindrical embedded recess 12 of the shaft body 10, in which the grip-side cylindrical end surface 21 of the metal cylinder 20 and the grip-side cylindrical end surface 13 of the cylindrical embedded recess 12 abut each other in the shaft longitudinal direction and in which the tip-side cylindrical end surface 22 of the metal cylinder 20 and the tip-side cylindrical end surface 15 of the cylindrical embedded recess 12 abut each other in the shaft longitudinal direction, is completed.

As described above, according to the first and second embodiments, by simply embedding the metal cylinder (weight-adding cylinder) 20 in the cylindrical embedded recess 12 of the inner wall 11 of the shaft body 10 on the tip side of the shaft body 10, the center of gravity of the golf club shaft 100 or 200 is shifted toward to the tip end so that the golf club shaft 100 or 200 that provides a feeling which is closer to that of a steel shaft is achieved. In addition, since a general-purpose member can be used as the metal cylinder 20, the golf club shaft 100 or 200 can be achieved at low cost. Additionally, since the metal cylinder 20 is embedded in the cylindrical embedded recess 12 of the inner wall 11 of the shaft body 10 and also since the grip-side cylindrical end surface 21 of the metal cylinder 20 and the grip-side cylindrical end surface 13 of the cylindrical embedded recess 12 are in contact with each other (abut against each other in the shaft longitudinal direction), the metal cylinder 20 does not come off the shaft body 10 toward the grip side even if an impact is exerted on the golf club shaft when the golf club is swung or the ball is hit, thus making it possible to enhance the durability of the golf club shaft 100 or 200.

In the above described first and second embodiments, the position of the center of gravity of the golf club shaft 100 or 200 is shifted toward the shaft tip by the embedding of the metal cylinder (weight-adding cylinder) 20 in the cylindrical embedded recess 12 that is formed in the inner wall 11 of the shaft body 10 on the tip side thereof. However, the position in which the metal cylinder (weight-adding cylinder) 20 is embedded is not limited to a position on the tip side of the shaft body 10 and can be any arbitrary position in the longitudinal direction of the shaft body 10 (e.g., a position on the shaft rear end side). This makes it possible to set the weight balance of each golf club shaft 100 and 200 in the shaft longitudinal direction freely, reproducibly and easily.

Although the small diameter portion 32 of the mandrel 30 is formed into a cylindrical columnar shape while the metal cylinder 20 is formed into a cylindrical shape in the above first and second embodiments, it is also possible that the small diameter portion 32 of the mandrel 30 be formed into a tapered shape which decreases in diameter toward the tip side while the outer diameter portion 24 of the metal cylinder 20 be formed into a tapered shape corresponding to the tapered shape of the small diameter portion 32.

Although the case where the shaft body is made of an FRP (Fiber Reinforced Plastics) formed by winding and thermosetting a plurality of uncured thermosetting resin prepregs has been illustrated in the above described first and second embodiments, the present invention can also similarly be applied to the case where the shaft body is made by a filament winding method.

Although the case where a metal cylinder is used as a weight-adding cylinder in the above described first and second embodiments, a cylinder made of, e.g., ceramics can be used instead of a metal cylinder.

Industrial Applicability

A golf club shaft according to the present invention and a golf club using this golf club shaft are suitably used in playing golf.

DESCRIPTION OF THE REFERENCE NUMERALS

100 200 Golf club shaft
10 Shaft body

11 Inner wall
12 Cylindrical embedded recess
13 Grip-side cylindrical end surface
14 Shaft tip end surface
15 Tip-side cylindrical end surface
20 Metal cylinder (weight-adding cylinder)
21 Grip-side cylindrical end surface
22 Tip-side cylindrical end surface
23 Inner diameter portion
24 Outer diameter portion
30 Mandrel
31 Large diameter portion
31*a* Tip
32 Small diameter portion
33 Stepped connecting portion
40 0-degree prepreg-wound cylinder
41 Tip-side cylindrical end surface
42 Outer diameter portion
50 0-degree prepreg-wound cylinder
51 Grip-side cylindrical end surface
52 Outer diameter portion
P Uncured thermosetting resin prepregs
P1 Metal-cylinder coating prepreg
P2 P3 Bias prepreg
P4 Straight prepreg
P5 End-reinforcing prepreg (triangular prepreg)

The invention claimed is:

1. A golf club shaft which includes a metal cylinder entirely made of a metallic material and a hollow-cylindrical shaft body that contains at least a part of said metal cylinder in a longitudinal direction thereof and is formed by thermally curing a plurality of uncured thermosetting resin prepregs wound around said metal cylinder, wherein said metal cylinder is positioned in a portion of said hollow-cylindrical shaft body in a longitudinal direction thereof, and wherein at least a part of an outer diameter side of said metal cylinder is embedded in an cylindrical embedded recess that is formed in an inner wall of said shaft body, wherein a grip-side cylindrical end surface of said metal cylinder and a grip-side cylindrical recess end surface of said cylindrical embedded recess are in contact with each other.

2. The golf club shaft according to claim 1, wherein a tip-side cylindrical end surface of said metal cylinder is exposed with a shaft tip end surface of said shaft body.

3. The golf club shaft according to claim 1, wherein a tip-side cylindrical end surface of said metal cylinder is in contact with a tip-side cylindrical recess end surface of said cylindrical embedded recess.

4. The golf club shaft according to claim 1, wherein said metal cylinder is covered with a 0-degree prepreg layer which is positioned on said metal cylinder, and a long fiber direction of which is parallel to a shaft longitudinal direction of said golf club shaft.

5. The golf club shaft according to claim 1, wherein said a contact length in a radial direction between said grip-side cylindrical end surface of said metal cylinder and said grip-side cylindrical recess end surface of said cylindrical embedded recess ranges from 0.05 mm to 0.5 mm.

* * * * *